US005823790A

United States Patent [19]

Magnuson

[11] Patent Number: 5,823,790

[45] Date of Patent: Oct. 20, 1998

[54] CONNECTOR FOR ATTACHING A CABLE TO A PRINTED CIRCUIT BOARD

[75] Inventor: Scott A. Magnuson, Fair Haven, N.J.

[73] Assignee: Lucent Technologies Inc., Murray Hill, N.J.

[21] Appl. No.: 681,749

[22] Filed: Jul. 29, 1996

[51] Int. Cl.[6] ..... H01R 9/09

[52] U.S. Cl. ..... 439/63

[58] Field of Search ..... 439/63, 581, 92; 333/33, 34, 260

[56] References Cited

U.S. PATENT DOCUMENTS 4,690,482 9/1987 Chamberland et al. ..... 439/578

4,779,064 10/1988 Monser ..... 333/81 A 5,120,258 6/1992 Carlton ..... 439/581

5,190,474 3/1993 Ginet ..... 439/581

*Primary Examiner*—Neil Abrams

*Assistant Examiner*—Barry M. L. Standig

[57] ABSTRACT

An SMA PC mount connector for attaching a test cable for test equipment to a printed circuit board. The connector includes a conductor element having a reduced diameter so as to substantially eliminate impedance discontinuity resulting from the contact between the conductor element and the ground planes of the board at the mounting junction between the connector and the board to enable a more accurate measurement of the impedance of the true impedance of the board.

7 Claims, 3 Drawing Sheets

CONNECTOR FOR ATTACHING A CABLE TO A PRINTED CIRCUIT BOARD

FIELD OF THE INVENTION

The present invention relates to connectors. In particular the present invention relates to an improved SMA PC mount connector for connecting a coaxial cable to a printed circuit board for connecting the circuit board to test equipment, with the impedance discontinuity created by the connector minimized to enable accurate detection of circuit generated signals on the printed circuit board by the test equipment.

BACKGROUND OF THE INVENTION

As part of development of frequency generation equipment integrated onto a printed circuit board, such boards must be tested to determine the circuit generated signals produced by the board. Typically such boards are tested with an oscilloscope which measures the signal of the boards and thus the frequency generation equipment mounted thereon over a range of frequencies. The boards generally are linked to the oscilloscope by coaxial cables connected to the boards by SMA PC mount connectors.

FIG. 1A illustrates a conventional SMA connector 1 which includes a body 2 having a mounting pad 3 of copper or similar conductive material at one end. A core 4 (FIG. 1B) formed from a dielectric material such as TEFLON® (polytetraflourene) or a similar material is positioned within the body and receives a conductor element 6 therethrough. Additionally, a series of locating spacer legs 7 (FIGS. 1A and 1B) are arranged about the core, mounted to and extending forwardly from the mounting pad 3. The legs are used to help locate and mount the connectors to a printed circuit board 8, as shown in FIG. 2, and to establish ground connections between the connector and the board. These conventional connectors generally are mounted to the printed circuit boards 8 by the insertion of the legs 7 and conductor elements 6 of the connectors 1 through openings 9 formed in mounting pads 11 attached to the boards 8. Thereafter, the legs are soldered to the mounting pads 11 to fix the connectors 1 to the boards for attaching a coaxial cable 12 thereto.

The primary problem with conventional SMA PC mount connectors is that such connectors tend to create a substantial impedance discontinuity at the connections of the connectors to the board. Such impedance discontinuities are due to capacitances created between the legs surrounding the center conductor of the connector and the attached stripline and the dielectric of the board. Also, these discontinuities result from the surface area of the center conductors of such connectors coupled to the ground planes of the board, the greater the surface area of the conductor, the more capacitance that is generated, and thus the greater the discontinuity. These impedance discontinuities in turn cause distorted signals to be observed on the oscilloscope that vary significantly from the actual signal of the test board and which cannot be statistically eliminated, especially during high-speed band evaluations. For example, a reading of 25–30 ohms can be detected where a desired target value of 50 ohms was expected, thus making it extremely difficult to get a true reading of the signal distortion of the test board. Thus, it generally has been difficult to determine a true measure of the actual signal as a result of the significant impedance discontinuities created by conventional SMA connectors. Also, the center conductors of such connectors generally have had to be relatively large, which further increases the impedance discontinuity due to capacitance created between the legs and the center conductor of conventional connectors.

Additionally, conventional Surface Mount Technology (SMT) connectors generally require additional mounting pads to be applied on the boards for receiving mounting legs. The legs are then soldered directly to the boards. However, such soldering of the legs to the boards generally necessitates the use of special soldering apparatus for soldering the conductors of the connectors to the boards, and provides only a limited, weak connection between the connectors and the boards. Such a weak connection is a result of the legs providing limited flush mounting or engagement of the connector mounting pad against the board. Consequently, with only the soldered attachment of the legs to the board holding the connector in place, the torque generated by repeated screwing of the cable couple onto the connector exerts a strain on the conductor of the connector, which can easily cause breaking of the soldered connections of the legs and of the conductor of the connector to the board. Additionally, the forces the cable exerts on the connector can weaken the board to connector engagement.

Accordingly, it can be seen that a need exists for an SMA connector for printed circuit boards which reduces the capacitance effects at the board connector mounting junction to reduce substantially the impedance discontinuity thereat to enable a truer reading of the actual impedance or signal distortion created by the printed circuit boards.

SUMMARY OF THE INVENTION

Briefly described, the present invention comprises an SMA PC vertical mount connector for connecting a coaxial test cable to a printed circuit board for connecting the printed circuit board to an oscilloscope or similar testing equipment for testing, for example, frequency generated equipment integrated on the printed circuit board. The connector generally includes a substantially cylindrically shaped connector body having a proximal or first end and a distal or second end. The distal or second end of the connector body includes helical threads formed thereabout for attaching the coaxial cable to the connector. A central core formed from a dielectric material such as polytetraflourene, commonly known as TEFLON®, is received within the conductor body, extending partially along its length from its forward or proximal end toward the distal end thereof. The proximal end further includes a mounting pad formed as a substantially circular disc that radially overlaps the proximal end of the connector.

A conductor element is mounted within the center of the dielectric material of the core and typically includes a rod or pin that projects outwardly from the proximal end of the connector. A conductor sleeve extends from the rearward end of the conductor pin toward the distal end of the connector. The sleeve receives a conductor pin of the coaxial cable therein to establish an electrical connection. The conductor element typically will be of a reduced diameter over conventional SMA connectors and will be spaced from the mounting pad about the proximal end of the connector. Generally, a copper pad typically is mounted to the printed circuit board at the point where the SMA PC mount connector is inserted into the board. The conductor element further functions as a locating means for guiding the connector into engagement with the board with the mounting pad of the connector in substantially flush mounted attitude against the board mounting pad.

The use of a reduced diameter connector significantly reduces the impedance discontinuity created between the conductor and the ground planes of the printed circuit board to which the connector is mounted by reducing the surface area of the conductor element and thus reducing the electrical field contact between the conductor element and the ground planes of the board. The mounting pad at the proximal end of the connector is soldered to the copper mounting pad of the printed circuit board to establish a secure connection between the board and the SMA PC mount connector without requiring spacer or locating legs attached to the mounting pad for mounting the connector to the board. Ground connections are provided by connecting vias between the board ground plane and the mounting pad. The mounting pad and ground via connection combination allows the user to arrange the via geometry as needed in lieu of the restrictive through board legs of conventional SMA connectors.

The construction of the present invention thus enables a truer measure of the impedance or signal distortion of the frequency generation equipment integrated on the printed circuit board, especially during high speed band measurement operations of such digital systems, than can be achieved with current conventional SMA connectors by the reduction of impedance discontinuities created by the contact of the electrical field of the conductor and the ground planes of the board. The elimination of the spacer legs further eliminates the incidence of impedance discontinuities resulting from capacitances created between the legs and the dielectric of the board and the center connector.

Various objects, features and advantages of the present invention will become apparent to those skilled in the art upon reading the following detailed description, when taken in conjunction with the accompanying drawings.

DETAILED DESCRIPTION

Figure 1A:
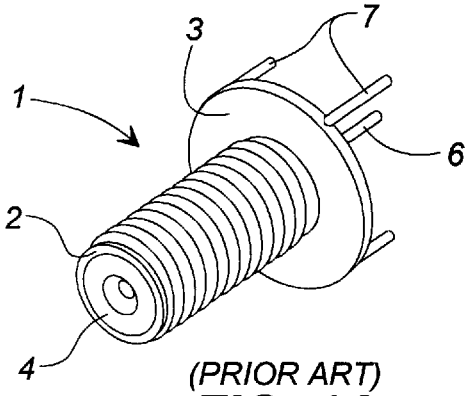
(PRIOR ART) FIG. 1A
FIG. 1A is a perspective view of a conventional SMA PC mount connector.

Referring now in greater detail to the drawings in which like numerals indicate like parts throughout the several views, FIG. 3A, 3B, 3C and 4 illustrate the SMA PC mount connector 20 of the present invention for use in connecting a coaxial test cable 21 (FIG. 4) to a printed circuit board 22 having frequency generating equipment, indicated generally by 23, mounted thereon to attach the printed circuit board to a test device such as an oscilloscope (not shown). The printed circuit board generally is a conventional type printed circuit board that includes an insulating board or card 24 formed from a dielectric material and on which copper conductors 26 are laminated or formed, such as by photochemical etching. The conductors include striplines 27 sandwiched between ground planes internal to the board or card 24 of the printed circuit board. The striplines 27 generally are connected at their ends to mounting pads 28, each of which generally comprises a round shaped pad formed from copper or similar conductive material applied to the inner surface of the printed circuit board where the stripline terminates. Each of the mounting pads includes an aperture 29 formed approximately centrally therethrough which is plated with copper or similar conductive material.

Figure 3A:
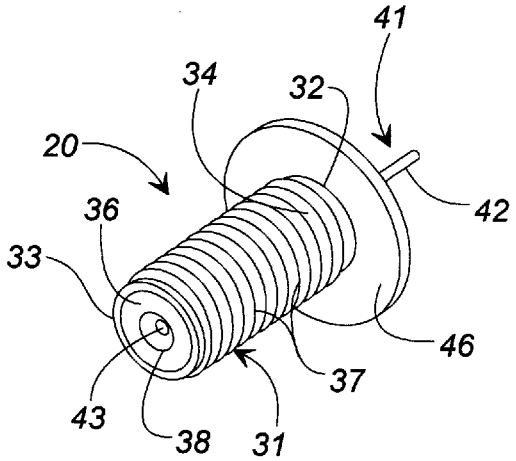
FIG. 3A is a perspective view of the SMA PC mount connector of the present invention.
Figure 3B:
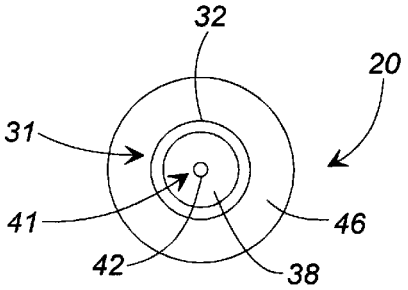
FIG. 3B is an end view of the SMA PC mount connector of the present invention.
Figure 3C:
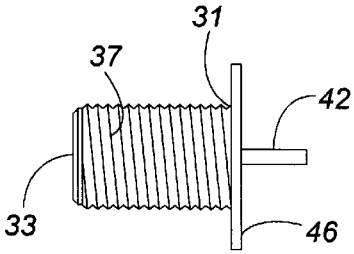
FIG. 3C is a side view of the SMA PC mount connector of the present invention.

As shown in FIGS. 3A, 3B, and 3C the SMA PC mount connector 20 includes a connector body 31 generally formed from a metal such as brass plated with gold or copper or similar conductive materials such as are conventionally used for such connectors. The connector body generally is substantially cylindrically shaped and has a proximal end 32 and a distal end 33 and a substantially cylindrical side wall 34 that defines a longitudinally extending inner channel or passage 36 (FIG. 3A). Helical threads 37 are formed about the side wall 34 of the connector body extending from a point intermediate the proximal and distal ends to the distal end 33 of the connector body 31. The threads enable the connection of the test cable to the distal end of the connector. A core 38 is received within and extends along the open ended channel 36 substantially along the length of the connector body. The core generally is formed from a dielectric material, typically a material such as polytetraflourene, commonly known as TEFLON®, or similar insulating material.

A conductor element 41 is received approximately through the center of the core 38 and extends substantially along the length of the connector body 31. The conductor element includes a conductor pin 42 that projects outwardly from the proximal end of the connector body, and a sleeve 43 that extends through the dielectric material of the core 38, terminating adjacent the distal end 33 of the connector body 31. The sleeve 43 receives the conductor of the test cable therein upon the attachment of the test cable to the SMA PC mount connector 20 to establish an electrical connection between the conductor element 41 of the connector 20 and the cable 21.

The conductor element 41 generally is formed from the same conductive material, i.e., brass plated with gold or copper, as the connector body and typically is of a diameter that is substantially less than the diameter of the conductor elements of conventional SMA PC mount connectors. In general, the conductor element will be of a diameter less than 30 mils. or 0.030 inches or less, which is significantly less than the diameters of the conductor elements of conventional SMA PC mount connectors. The conductor element 41 is received through an aperture 29 (FIG. 4) of one of the mounting pads 28 mounted to the printed circuit board 24, with the conductor pin 42 extending through the aperture and through a strip Line 27 to establish an electrical contact between the test cable 21 and the printed circuit board 22. The conductor thus acts as a locating means to guide the connector into a flush mounted attitude in engagement with the board.

Figure 4:
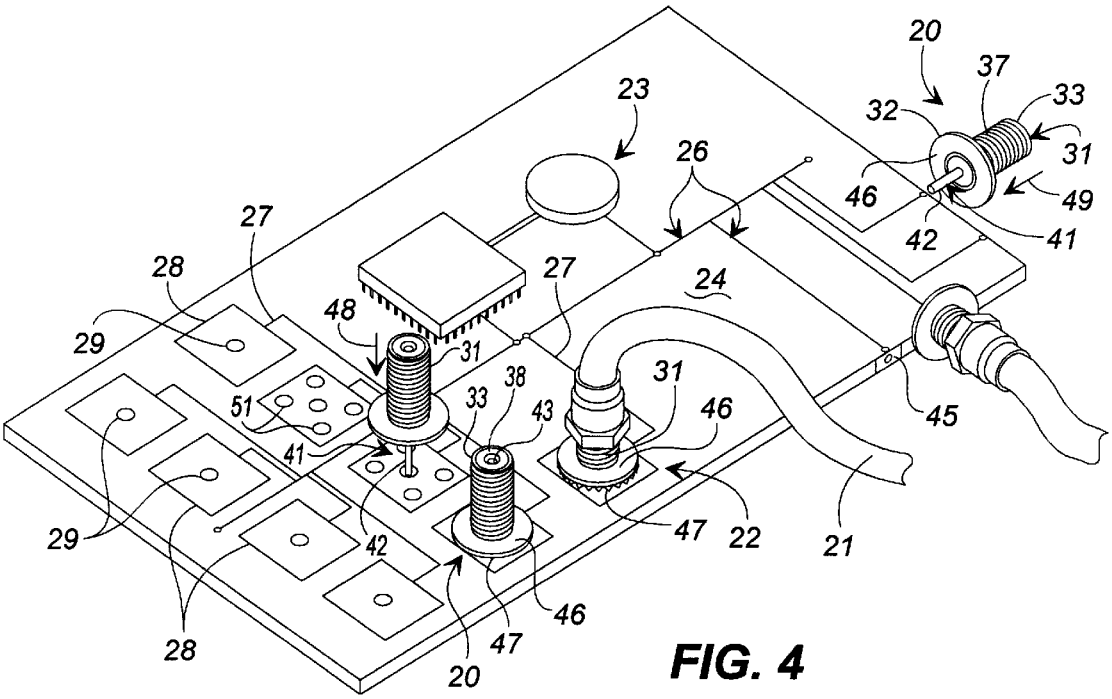
FIG. 4 is a perspective view of a printed circuit board illustrating the mounting of the SMA PC mount connector of the present invention thereto.

As illustrated in FIGS. 3A–4, a substantially circular shaped mounted pad 46 is formed at the proximal end 42 of the connector body 31 of each SMA PC mount connector 20. The mounting pad generally is formed as part of the PC mount connector, forming the proximal end thereof and radially overlaps or extends beyond the side wall 34 (FIGS. 3A and 4) of the connector body 31. The mounting pad is adapted to engage and lie substantially flat against a mounting pad 28 of the printed circuit board 24 in a flush mounted attitude as indicated in FIG. 4 with the conductor pin 42 of the SMA PC mount connector 20 inserted through the conducting aperture 29 of such a board mounting pad 28. In such a flat lying condition, the mounting pads 46 of the SMA PC mount connectors 20 can easily and quickly be soldered or otherwise connected, as indicated by 47, to its board mounting pad 28.

Figure 1B:
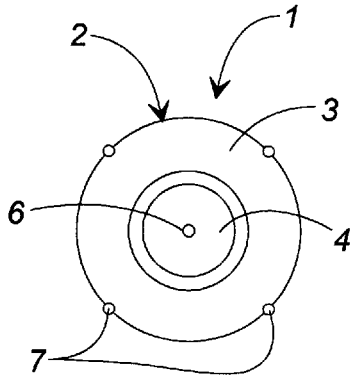
(PRIOR ART) FIG. 1B
FIG. 1B is an end view of the conventional SMA PC mount connector of FIG. 1A.
Figure 2:
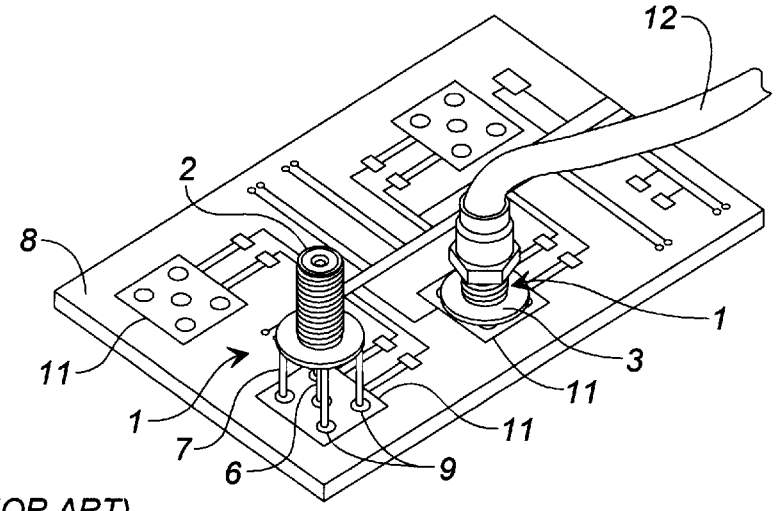
(PRIOR ART) FIG. 2
FIG. 2 is a perspective view of a printed circuit board illustrating the mounting of a conventional SMA PC mount connector thereto for connecting a cable to the printed circuit board.

Unlike conventional SMA PC mount connectors, as indicated in FIG. 1A and FIG. 1B, however, the connector 20 of the present invention does not include locating spacer legs mounted about and projecting forwardly from the mounting pad of such connector. Such spacer legs are not required as the combination of the flat mounting pads of the SMA PC mount connector 20 of the present invention and the mounting pads 28 affixed to the PC board 24 to which the SMA PC mount connector of the present invention connection does not require additional openings to be drilled within the PC board for receipt of the locating spacer legs therein. Instead the flush mounting of the connector mounting pad against the board mounting pad provides a simple, stable and secure connection between the connector and the board, and one which provides an excellent ground connection between the connector and the board so as to substantially eliminate capacitance created by the fixed spacing of the legs to the center conductor of commercial SMA connectors. Such a flush mounting further resists torque and stresses on the solder connection between the board due to the twisting attachment of the cable coupling to the connector to resist breaking the connection between the conductor and the board.

Typically, the SMA PC mount connector 20 is used in a vertical mount arrangement, indicated by 48 in FIG. 4, in which the connector is oriented vertically, perpendicular to the board. Additionally, the SMA PC mount connector of the present invention also can be used in an end launch mounting type arrangement indicated by 49 in FIG. 4. In such an end launch mounting arrangement, as opposed to the typical vertical mount arrangement for the connector, the connectors are mounted horizontally with their conductor pins extending into a side edge of the printed circuit board into engagement with a strip line 26 that terminates at 45 at the side edge.

In use of the SMA PC mount connector 20 of the present invention, as shown in FIG. 4, the connector is mounted to the printed circuit board by the insertion of its conductor element 41 through an aperture 29 of a mounting of a board mounting pad 28 with the conductor pin engaging and extending through a strip line 27 of the printed circuit board and its mounting pad 46 flush against the board mounting pad 28 in a vertical mount or end-launch type mounting and provide better mechanical mounting. Once positioned in engagement with the board, the mounting pad 46 further typically is soldered to the board mounting pad 28 to secure the connector to the board. In addition, the mounting pads 46 are be connected to the ground planes of the board by VIAS 51 formed through the board mounting pads. Thereafter, the distal or female end of the connector 22 is attached to the male connector at one end of the test cable, which typically is a coaxial cable, by the engagement of the threads 37 formed about the connector body 31 adjacent the distal end 33 of the conductor by the connector of the test cable. The opposite end of the cable is connected to test equipment, generally an oscilloscope, for monitoring the board's circuitry.

The reduced diameter of the conductor element 41 of the SMA PC mount connector of the present invention advantageously enables the substantial elimination of the impedance discontinuity that generally results with commercial SMA PC mount connectors. The reduced diameter of the conductor element provides less surface area for the connector center conductor element, which in turn reduces the capacitance created between the conductor element and the board due to there being a reduced electrical field contact between the conductor element and the ground planes of the printed circuit board. As a result, the impedance discontinuity generated by such capacitance is substantially eliminated. The substantial elimination of this impedance discontinuity thus enables the board to be designed with the ground planes closer to the center conductor mounting point so as to enable better control of the impedance of the strip lines themselves, without creating an increased impedance discontinuity between ground planes and the conductor pins of the connectors.

In addition, by doing away with the spacer legs required by most conventional SMA PC mount connectors, there is a further reduction in the impedance discontinuity created at the mount junction between the connector and the printed circuit board due to the capacities created between the spacer legs and the dielectric material of the PC board itself and the center conductor. As a result, the impedance discontinuities created between printed circuit boards used for the testing of frequency generation equipment or the like and the PC mount connectors used for connecting the test cable thereto for linking the PC boards to test equipment, such as an oscilloscope, are substantially eliminated. The SMA PC mount connector of the present invention thus enables a truer, more accurate reading of the actual signal distortion of the frequency generation equipment integrated on the printed circuit boards. The printed circuit boards therefore can be designed and built to a specific desired impedance, which enables greater standardization in the construction of such printed circuit boards to match desired impedances.

Figure 5:
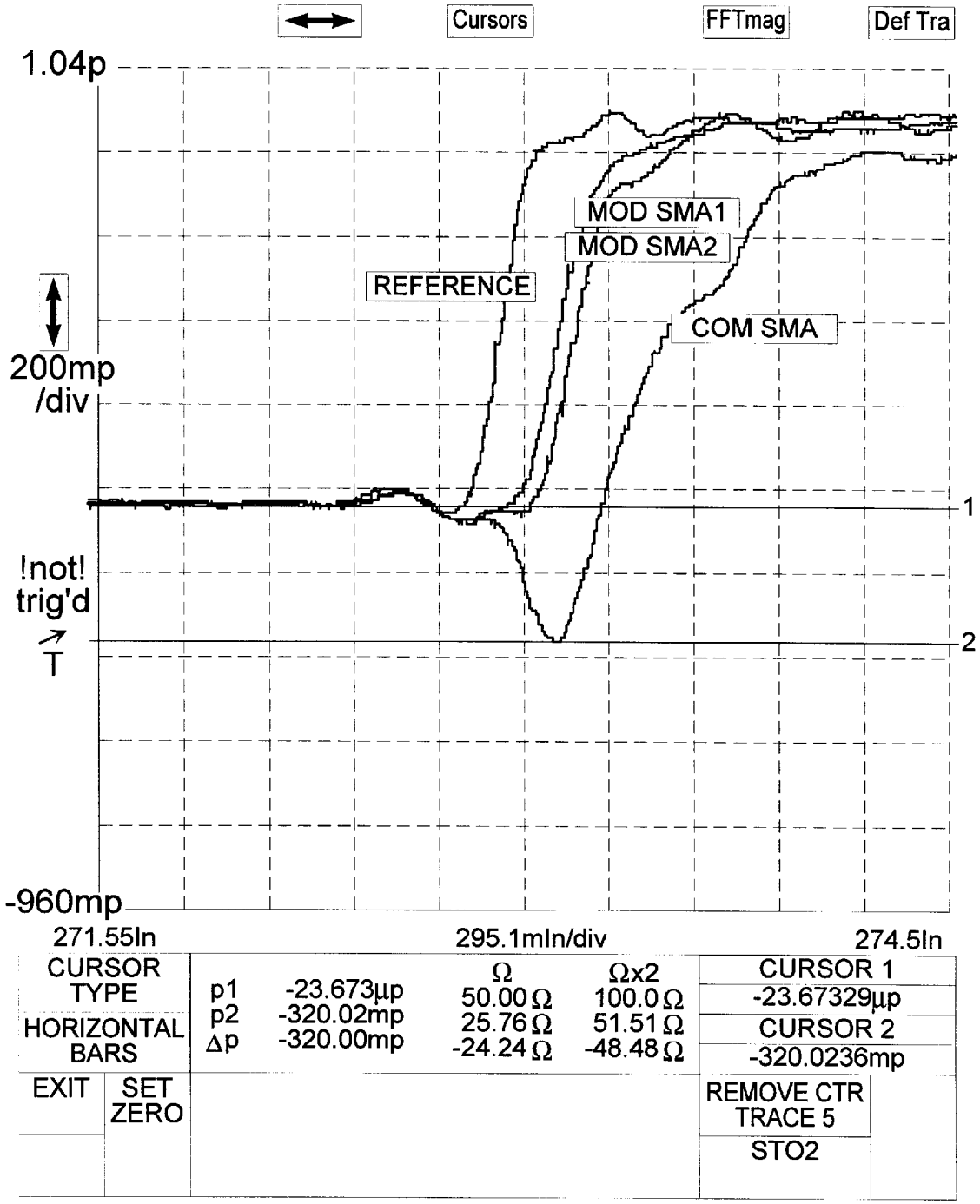
FIG. 5 is a graphic illustration comparing the impedances measured on a printed circuit board using a conventional SMA PC mount connector and SMA PC mount connector of the present invention.

As illustrated graphically in the FIGS. 5, in tests for measuring the impedance of a printed circuit board having the SMA PC mount connector of the present invention versus a commercial SMA PC mount connector mounted thereto to connect the test cables to the board, the impedance of the printed circuit board using the SMA mount connector of the present invention detected by the digital sampling oscilloscope was found to be much closer to the desired target impedance for the board than the impedance detected for a board connected thereto using a commercially available SMA PC mount connector. In FIG. 5, the ordinate illustrates the deviation from the norm of the impedance, while the abscissa illustrates the length of the discontinuity. The target value of the desired impedance for the printed circuit boards is approximately 50 ohms, which is generally indicated by the horizontal line labeled $\rho 1$. The curving line indicates the measured impedance of the board, which rises sharply to indicate the end of the connector on the backside of the board.

FIG. 5 illustrates the difference in the measurement of impedances between a commercially available SMA connectors, two modified SMA PC mount connectors of the present invention and a reference value of the impedance of the cable itself. In this figure, the upper horizontal line, indicated by $\rho 1$, indicates the desired target impedance for the board. The second, lower horizontal line, indicated by the $\rho 2$, indicates the depth of the impedance discontinuity from the desired target impedance of the board measured on a board using a conventional SMA PC mount connector. As indicated in FIG. 5, the impedance as measured on the boards connected with the modified SMA PC mount connectors of the present invention much more closely track the target impedance value, whereas there is a wide discrepancy, evidenced by the space between the two lines ρ1 and ρ2, between the target impedance value and the measured impedance value measured on a PC board using a convention SMA PC mount connector.

Thus, it can be seen that the present invention enables a much more accurate determination of the signals of a printed circuit board with only a minor deviation resulting from the mount junction of the SMA PC mount connector of the present invention to the board, which small discrepancy can be statistically eliminated so as to enable the printed circuit boards to be designed and built to a desired impedance on a much more standardized basis.

It will be understood by those skilled in the art that although the foregoing description describes the invention in detail with reference to a preferred embodiment thereof, various modifications, additions and deletions can be made thereto without departing from the spirit and scope of the invention as set forth in the following claims.

I claim:

1. A connector for attaching a cable to a printed circuit board to connect the printed circuit board to test equipment for measuring the impedance of the printed circuit board, with the impedance discontinuity resulting from a mount junction between the connector and the board being substantially eliminated to enable a reading of the impedance of the impedance frequency generation equipment of the board with increased accuracy, comprising:

a connector body having an outer sidewall, a proximal end, and a distal end adapted to attach to the cable;

a core of a dielectric material received within said connector body between said proximal and distal end thereof, a conductor element received and extending through said core spaced from said outer side wall of said connector body and having a diameter of less than approximately 30 mils; and means for reducing impedance discontinuities between said connector and the board, said means comprising:

a mounting pad attached to said connector body at said proximal end thereof and adapted to engage and lie substantially flush against a mounting pad for the printed circuit board; and means for securing the connector to the printed circuit board disposed at said engagement of said connector body mounting pad and said printed circuit board mounting pad and being substantially confined thereat.

2. The connector of claim 1 wherein said core of dielectric material comprises a substantially cylindrical body formed from polytetraflourene.

3. The connector of claim 1 and wherein said conductor element includes a pin conductor that projects from said proximal end of said connector body and a sleeve portion at said distal end of said connector body.

4. The connector of claim 1 and wherein said conductor and said connector body are formed from brass.

5. An SMA mount connector for attaching a test cable to a printed circuit board having frequency generation equipment integrated thereon to connect the printed circuit board to a measurement device for measuring the signal distortion of the frequency generation equipment of the board, with the impedance discontinuity resulting from the creation of localized capacitances resulting from the connection of the connector to the board being substantially eliminated to enable a substantially accurate measurement of the signal distortion, and thus the impedance of the board by the test equipment to enable more standardization of the construction of the board having a desired impedance, comprising:

a connector body having proximal and distal ends;

a core of dielectric material received within said connector body;

a connector mounting pad formed at said proximal end of said connector body, circumscribed about said core and adapted to engage and lie substantially flat against the board for attachment of the connector to the board;

a board mounting pad applied to the board and adapted to receive said connector mounting pad in a substantially flush mounted attitude thereagainst for attaching said connector mounting pad to mount the connector to the board, and having an aperture therethrough; and means for locating said aperture of board mounting pad for guiding the connector into its flush mounted attitude with the board, comprising a conductor element received and extending though said core of said conductor body and having a diameter so as to minimize capacitances existing between the board and said conductor to enable a more accurate measurement of the impedance of the board for constructing the board with a desired impedance.

6. The connector of claim 5 and wherein said core of dielectric material comprises a substantially cylindrical body formed from polytetrafluorine.

7. The connector of claim 5 and wherein said conductor element includes a pin conductor that projects from said proximal end of said connector body and a sleeve portion at said distal end of said connector body.

* * * * *